US005749679A

United States Patent [19]

Kromp

[11] Patent Number: 5,749,679

[45] Date of Patent: May 12, 1998

[54] METHOD AND DEVICE FOR LETTING OUT GAS FROM LIFE JACKETS OF DIVERS

[75] Inventor: Thomas Kromp, Essen, Germany

[73] Assignee: GfT Gesellschaft fuer Tauchtechnik mbH & Co. KG, Essen, Germany

[21] Appl. No.: 596,227

[22] PCT Filed: Aug. 16, 1994

[86] PCT No.: PCT/EP94/02719

§ 371 Date: Feb. 20, 1996

§ 102(e) Date: Feb. 20, 1996

[87] PCT Pub. No.: WO95/05306

PCT Pub. Date: Feb. 23, 1995

[30] Foreign Application Priority Data

Aug. 19, 1993 [DE] Germany ..... 43 27 833.7
Jul. 16, 1994 [DE] Germany ..... 44 25 223.4

[51] Int. Cl.[6] ..... B63C 11/02

[52] U.S. Cl. ..... 405/186; 405/192; 405/193

[58] Field of Search ..... 405/185, 186, 405/192, 193; 137/81.2

[56] References Cited

U.S. PATENT DOCUMENTS

| | | | |
|---|---|---|---|
| 2,945,506 | 7/1960 | Svensson | 137/81.2 X |
| 3,695,048 | 10/1972 | Dimick | 405/186 |
| 4,045,835 | 9/1977 | Flam et al. | 405/186 |
| 4,379,656 | 4/1983 | Darling | 405/186 |
| 4,437,790 | 3/1984 | Trop | 405/186 |
| 4,601,609 | 7/1986 | Hyde | 405/186 |
| 4,650,151 | 3/1987 | McIntyre | 137/81.2 X |
| 4,674,429 | 6/1987 | Buckle et al. | 137/81.2 X |

FOREIGN PATENT DOCUMENTS

WO 92/13756 8/1992 WIPO .

*Primary Examiner*—Tamara L. Graysay
*Assistant Examiner*—Tara L. Mayo
*Attorney, Agent, or Firm*—Spencer & Frank

[57] ABSTRACT

A method and a device for letting out gas from a life jacket for divers, the device being adapted to be in gas flow communication with an interior of the life jacket. Gas is drawn into the device from the interior of the life jacket, compressed in the device, and discharged from the device to a medium surrounding the device.

47 Claims, 6 Drawing Sheets

METHOD AND DEVICE FOR LETTING OUT GAS FROM LIFE JACKETS OF DIVERS

FIELD OF THE INVENTION

The invention relates to a method of, and to a device for, letting out air or gas from life jackets of divers, in particular of scuba divers.

BACKGROUND OF THE INVENTION

The actuating elements for activating the valves for letting air or gas into and out of the life jackets are arranged in an easy-to-reach region of the same and are generally actuated by pressing buttons. For this purpose, the air-inlet valve is supplied with compressed air from the compressed-air bottle. By actuating the inlet valve, the latter is moved from the shut-off position into an open position, in order then to release the path for the compressed air into the life jacket and thus to increase the buoyancy of the diver. In the same manner, the outlet valve is opened in order to allow air to escape from the life jacket and thus to reduce the buoyancy.

The disadvantage with the known systems is that these have to be fitted above the air volume in the life jacket, in order to ensure that the air can escape and is not trapped in the manner of an air bubble below a valve which is submerged in the water with the opening downwards. A further disadvantage with the known air-outlet valves is that, in the open position, the inner part of the life jacket is in direct connection with the water surrounding the diver, with the result that, depending on the design of the valves, a greater or lesser quantity of water can pass into the life jacket, and the air volume available for adjusting the buoyancy thus becomes lower.

A measure such as the one above is described in the text book Pady Diver Manual, Pady EU Services, Hettlingen, Chapter 1, page 21, in the "Features" section. Here, there is even a recommendation for a separate water-discharge valve for improved emptying of water which has penetrated into the life jacket. Furthermore, the valve or valves has/have a strictly non-linear behaviour, i.e. a behaviour dependent on the surrounding conditions, by way of which the desired adjustment of the buoyancy is rendered disproportionately more difficult.

SUMMARY OF THE INVENTION

The object of the invention is to realise a method and a device by means of which, by optimizing the air-outlet valve, the safety of the diver is increased, it being the intention for the air-outlet valve to be arranged at any location. Furthermore, the direct connection of the inner part of the life jacket, via the open outlet valve, to the water is to be avoided, in order thus to prevent water from penetrating into the life jacket in an undesired manner. Finally, the outlet behaviour is to be linearized, in order to simplify the adjustment of the buoyancy/depression.

This aim is achieved, in the case of the inventive method of letting out air or gas from life vests of divers, in particular of scuba divers, by a predeterminable air quantity or a predeterminable air-quantity fraction being discharged, by a continuous or discontinuous intake and displacement operation, from the interior of the life jacket to the medium surrounding it.

Advantageous developments of the method according to the invention are set forth further below.

The object is, furthermore, achieved by a device for letting out air or gas from life jackets of divers, in particular of scuba divers, having at least one housing which is in operative connection with the life jacket and contains at least one valve by means of which a piston, which can be activated by means of an actuating element, can be moved between two end positions within a piston chamber, which piston, by virtue of its alternating movement for air intake, air compression and air displacement, actuates at least one downstream nonreturn valve and at least one shut-off valve.

Advantageous developments of the device according to the invention are set forth further below.

By virtue of the invention, it is, then, possible by means of a piston with integrated nonreturn valve, for air to be taken in from the interior of the life jacket into a piston chamber, on the one hand, and, in the next operating cycle, for air to be displaced out of the piston chamber, via a further downstream shut-off valve, designed as a nonreturn valve, and discharged to the medium surrounding the life jacket. By the operation of taking in the air from the interior of the life jacket, the fitting location of the air-outlet valve can be freely selected. The operation of air displacement from the piston chamber makes it possible to select a relatively small outlet cross-section, which results in it being possible for the entire valve to be designed to be very small. By virtue of the reduced outlet cross-section and of the resulting high flow speed of the outgoing air, the penetration of water into the piston chamber can, then, be avoided to the greatest extent. Any water penetrating into the piston chamber is forced out again during the displacement operating cycle. By the operations of taking in and displacing the air via the piston, a precisely defined quantity of air is delivered from the interior of the life jacket with each operating cycle, said quantity corresponding to the product of the piston cross-section and the piston stroke. This is verified by the following formula derivation:

$$V_K = A_K \times H_k,$$

where $V_K$=delivery volume per operating cycle $A_K$=piston cross-section $H_K$=piston stroke $$A_K = d_K \times d_K \times pi/4$$

where $d_K$=piston diameter

The air-volume flow Q coming from the interior of the life jacket is given by the delivery volume $V_K$ multiplied by the number of operating cycles per unit of time or by the frequency f[Hz] at which the piston is actuated.

$$Q = V_K \times f \text{ or } Q = A_K \times H_K f.$$

Since the piston cross-section $A_K$ is constant and the piston stroke $H_K$ and the frequency f can be adjusted via corresponding actuating elements, the outgoing air-volume flow can be adjusted precisely and independently of surrounding conditions, e.g. pressure loss, flow resistance, viscosity and temperature.

In accordance with a further embodiment of the invention, the piston speed can be controlled corresponding to a sine function, with the result that the piston moves smoothly into its end positions and, due to the reduction in the speeds when the end positions are reached, the maximum speed of the piston outside the end positions can be selected to be high. By virtue of this measure, damage to the piston and housing as a result of excessive end-position speeds of the piston can be avoided.

Preferably, in at least one of its two end positions, but preferably in both end positions, the piston is set to 0 in terms of its speed over defined periods of time in each case, in order to ensure to the optimum extent that air is let out, with the result that dynamic influences, e.g. due to mass inertia of the nonreturn valve and/or of the shut-off valve, can at least be reduced.

Furthermore, there is the possibility that, in at least one of its end positions, the piston mechanically actuates the nonreturn valve and/or the shut-off valve, with the result that any remaining residue of positive air pressure or negative air pressure can dissipate.

The piston can be controlled manually or automatically by a control electronics unit. Actuation can be carried out using pneumatic, hydraulic or electromagnetic auxiliaries.

In an alternative method, the air is taken in by a rotator unit which acts as a pump and, for its part, is driven mechanically by a unit acting as a motor. The motor unit is preferably supplied with compressed air from the region of the inflator hose. In the case of this alternative method, the piston interacting with the nonreturn valve and the shut-off valve and the pilot-control piston is thus substituted by the drive and delivery elements of motor and pump, the operation of air intake, compression and displacement being maintained in its general form.

An alternative device for letting out air or gas from life vests contains a housing which is in operative connection with the life vest and contains at least one valve by means of which a unit, which acts as a motor and is connected to a rotator unit which acts as a pump, is driven, said unit, in turn, being connected, via a line, to the interior of the life jacket. In this arrangement, the valve is a proportional 2/2-way valve. Furthermore, provision is made for a measuring device which is in operative connection with a computer unit and determines the level of the air-volume flow.

BRIEF DESCRIPTION OF THE DRAWINGS

The invention is described as follows and is represented in the drawings, with reference to an exemplary embodiment, in which.

DETAILED DESCRIPTION OF THE INVENTION

Figure 1:
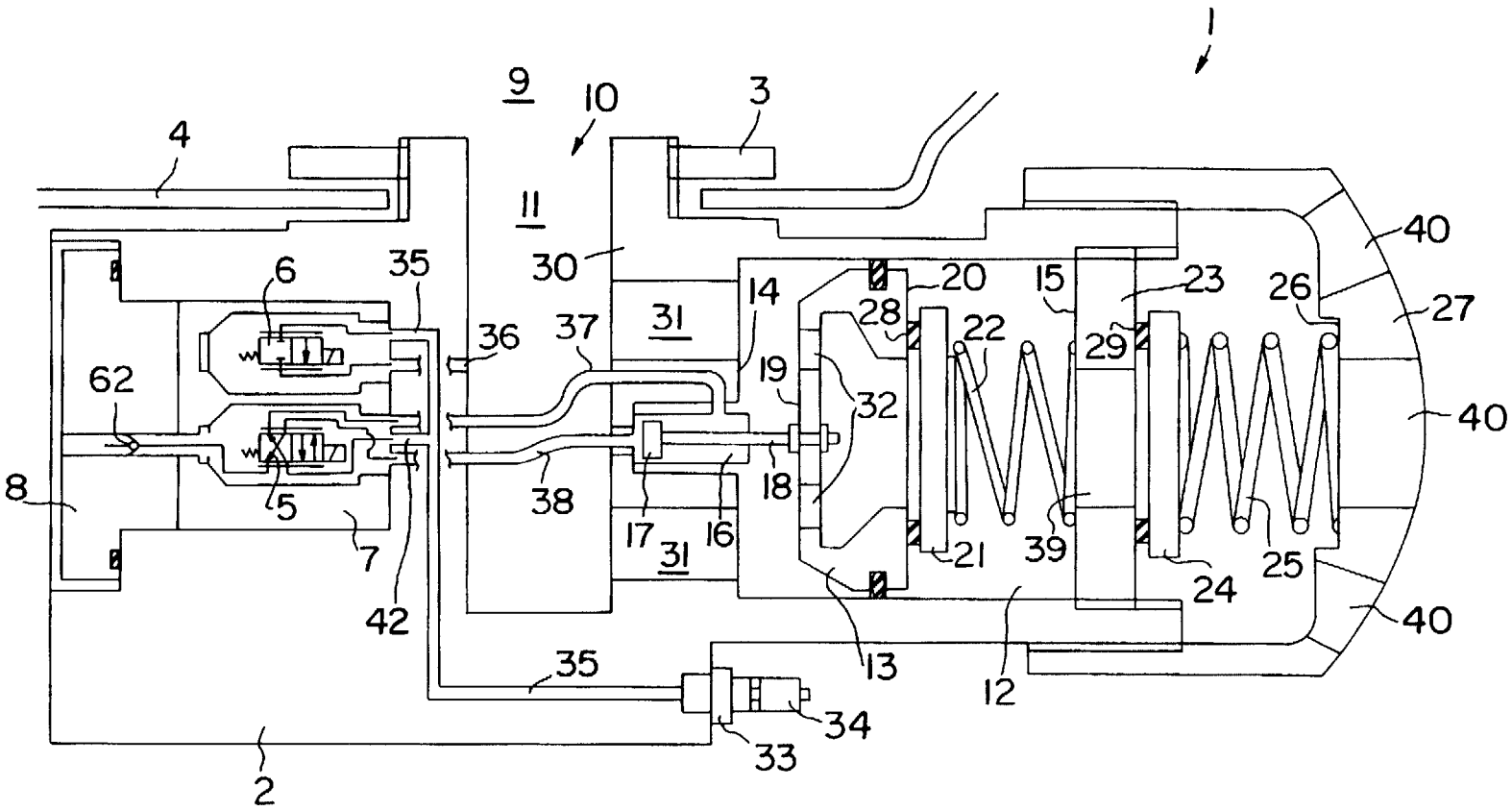
FIG. 1: is a schematic, cross-sectional view of a valve according to the invention in its rest position.

As seen in FIG. 1, the device 1 according to the invention contains a housing 2 which is connected releasably to a life jacket 4 via a screw-connection 3. Arranged in the region of the housing 2 are, inter alia, a 4/2-way pilot-control outlet valve or drive valve 5 and a 2/2-way pilot-control inlet valve 6, these both being designed in this example as proportional directional valves. The chamber 7 receiving the valves 5, 6 is sealed in a pressure-tight manner by means of a closure element 8. The interior 9 of the life jacket, indicated here only by the reference numeral 9, is, in the region of the screw-connection 3, in operative flow connection, via a corresponding clearance 10, with the housing interior 11 of the device 1, with the result that equal pressures prevail. Arranged within a piston chamber 12 adjoining the housing interior 11 is a sealed piston 13 which can be moved back and forth between two end positions 14, 15. This alternating movement of the piston 13 is achieved by means of a pilot-control piston 17 which is arranged in a pneumatic cylinder 16, serves as an actuating element and whose piston rod 18 is connected to the associated end face 19 of the piston 13. On the end side 20 remote from the pilot-control piston 17, the piston 13 interacts with a nonreturn valve 21 which is supported, via a compression spring 22, on a stationary valve seat 23. On that side of the valve seat 23 remote from the piston chamber 12, provision is made for a shut-off valve 24, which is likewise designed as a nonreturn valve, but acts in the opposite direction, and, analogously to the nonreturn valve 21, interacts with a compression spring 25, which is supported on the rear wall section 26 of a termination cap 27. Both the nonreturn valve 21 and the shut-off valve 24 are sealed, by corresponding sealing elements 28, 29, with respect to the corresponding components, that is to say the piston 13 and the valve seat 23. The rear wall 30, which terminates the piston chamber 12 with respect to the housing interior 11, exhibits through-passage openings 31. The same applies for the piston 13, which is likewise provided with through-passage openings 32, with the result that the pressure being set in each case in the interior 9 of the life jacket also acts on the seal 28 of the nonreturn valve 21 in the rest position of the piston 13. Provided on the housing 2 of the device 1 is a connection 33 for an inflator hose 34, only indicated here, via which compressed air can be fed from the compressed-air bottle (not shown in any more detail), through the pilot-control compressed-air feedline 35, to the pilot-control inlet valve 6 which, with corresponding actuation, can introduce air into the clearance 10 and thus into the interior 9 of the life jacket. This is indicated in the region 36. As has already been mentioned, the pilot-control outlet valve 5 is designed as a 4/2-way valve, it being possible for four connections and two switching positions to be realized. The two outlets of the pilot-control outlet valve 5 are routed, via the feedlines 37, 38, to the inlets of the pneumatic cylinder 16, i.e. the feedline 37 is routed to the ring surface for the retraction of the pilot-control piston 17 and the feedline 38 is routed to the piston surface for the extension of the pilot-control piston 17. By virtue of the fixed connection of the pilot-control piston 17 to the piston 13, the latter is analogously moved back and forth in an alternating manner within the piston chamber 12 between the end positions 14 and 15. In the rest position of the pilot-control outlet valve 5, the pressure is directed onto the ring surface, with the result that the pilot-control piston 17 is retracted and the piston 13 is located in the bottom dead centre position (end position 14). Upon activation of the pilot-control outlet valve 5, the pressure is directed, via the line 38, onto the piston surface of the pilot-control piston 17, with the result that the latter is extended and the piston 13 is moved, counter to the spring force of the compression spring 22, in the direction of the top dead centre position (end position 15). In the same manner, the shut-off valve 24 is deflected counter to the spring pressure of the compression spring 25 and is raised from the valve seat 23. If, in this position, air were to be present in the piston chamber 12, said air would be discharged to the medium surrounding the life jacket 4 through the valve seat 23, equipped with a concentric through-bore 39, and the through-openings 40 provided in the termination cap 27. Arranged downstream of the pilot-control outlet valve 5 is a nonreturn valve 62, by means of which the penetration of water into the chamber 7 is prevented.

Figure 2:
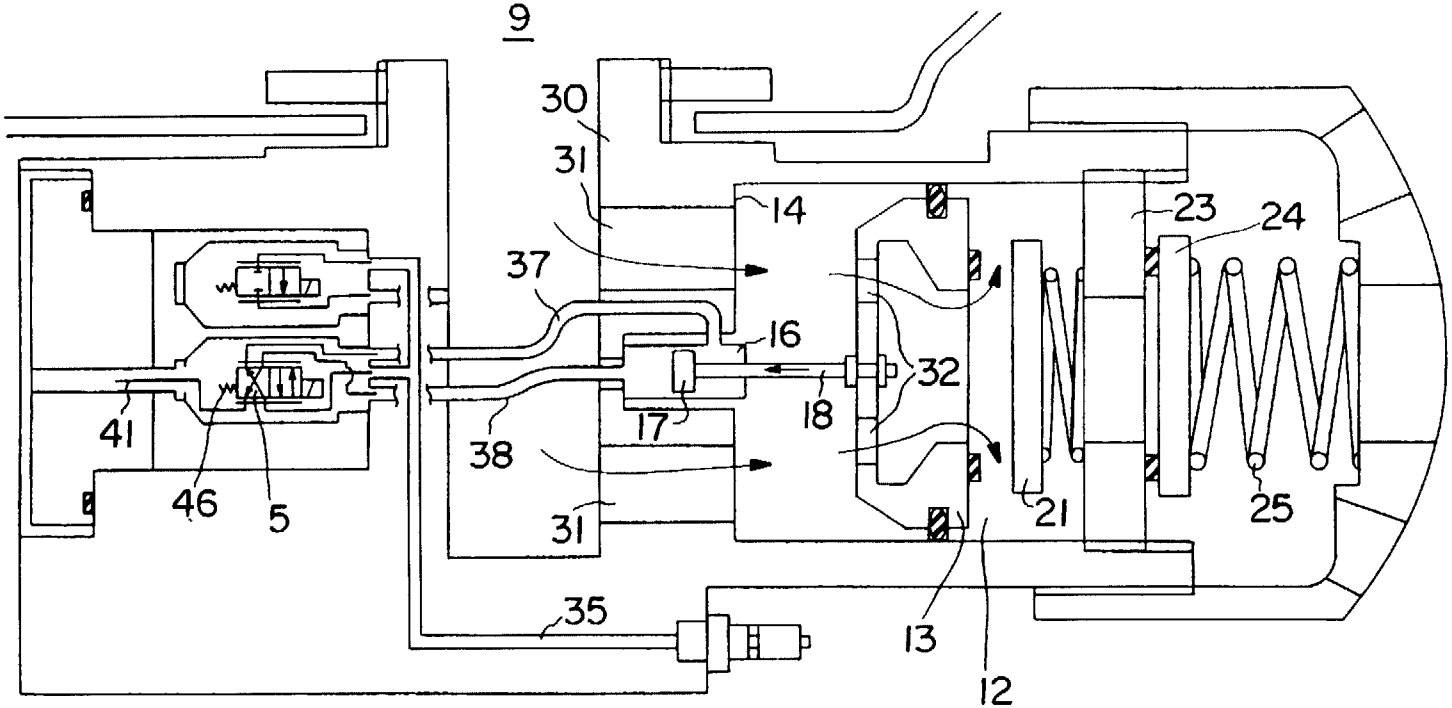
FIG. 2: is a view similar to FIG. 1 showing the valve in its air-intake operating cycle.

FIG. 2 shows the operating cycle where air is or drawn from the interior 9 of the life jacket into the piston chamber 12. In this arrangement, the flow direction is represented by arrows. When the pilot-control outlet valve 5 is located in the rest position, the spring 46 of the same forces the valve 5 into a position, where, by way of the pilot-control compressed-air feedline 35, compressed air is directed, by the cross position of the valve 5, onto the ring surface of the pneumatic cylinder 16 and the pilot-control piston 17 is thus retracted, as a result of which the piston 13 is moved in the direction of the end position 14. The electrically deenergized pilot-control outlet valve 5 is in such a position that the pressure in the feedline 38 can be dissipated via the air-discharge line 41, in which the nonreturn valve 62, mentioned in FIG. 1, is introduced. By the movement of the piston 13 in the direction of its end position 15 as seen in FIG. 2, the air is taken into the piston chamber 12 from the interior 9 of the life jacket via the through-passage opening 31 in the rear wall 30 and the through-passage opening 32 in the piston 13 and the nonreturn valve 21, which is now raised as the result of the negative pressure being set in the piston chamber 12. In this arrangement, the shut-off valve 24 is still closed as a result of the negative pressure in the piston chamber 12 relative to the pressure of the surrounding medium and as a result of the prestressing of the spring 25.

Figure 3:
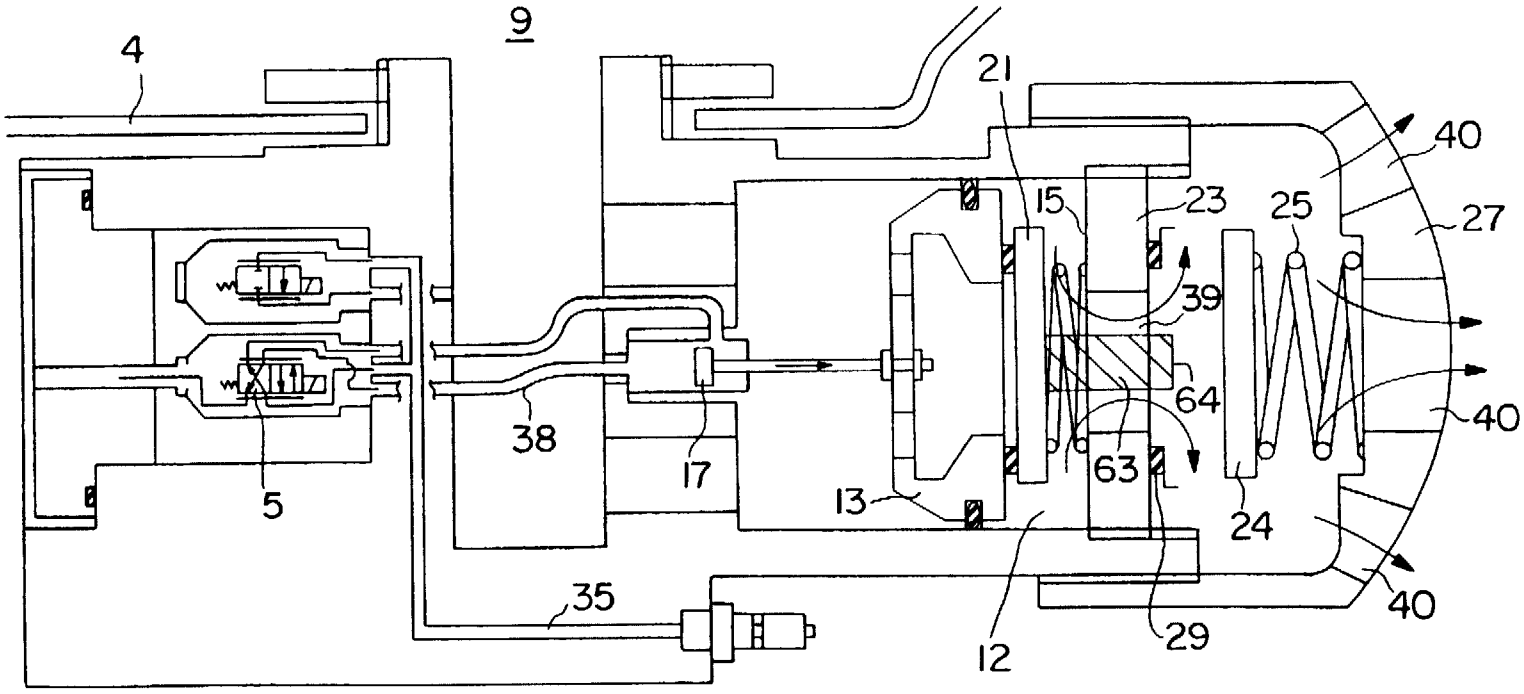
FIG. 3: is a view similar to FIG. 1 showing the valve in its air-displacement operating cycle.

FIG. 3, then, shows the operating cycle where the air is displaced from the piston chamber 12. Here too, the flow direction is marked by arrows. Here, the pilot-control outlet valve 5 is activated electrically, i.e. is switched in the throughflow direction, to be precise from the pilot-control compressed-air feedline 35 to the feedline 38 and onto the piston-side inlet of the pilot-control piston 17, as a result of which the piston 13 is deflected counter to the spring 22 and the air in the piston chamber 12 is first of all compressed until the shut-off valve 24 is opened counter to the force of the spring 25 and the air is discharged into the medium surrounding the life jacket 4 from the piston chamber 12, through the through-bore 39 in the valve seat 23 and the through-openings 40 in the cap 27. Once the piston 13 has reached its upper dead centre position (end position 15) and no more air is displaced, the shut-off valve 24 closes due to the force of the spring 25. The air-volume flow is obtained from the sequence of one or more operating cycles. If a low air-volume flow is to be set, i.e. operation is to take place at a low operating frequency, the piston 13 can remain in its upper dead centre position until the next stroke is to be carried out. Optionally, the piston 13 may also be moved into the outlet position, in order to remain there in the rest position until the next operating cycle. Integrally formed on the nonreturn valve 21 is an axial extension 63, of which the axial extent, in the end position 15 of the piston 13, projects beyond the seal 29. If compressed-air fractions are still present in the piston chamber 12 and the pressure thereof is lower than the force of the spring 25, this serves the purpose of closing the shut-off valve 24 again, the latter, however, in this arrangement being seated on the end surface 64 of the extension since the piston 13 has not yet moved in the other direction. The opening stroke of the shut-off valve 24 relative to the valve seat 23 and of the nonreturn valve 21 relative to the piston 13 is preferably measured (not shown) and the changeover of the pilot-control piston 17, and thus of the piston 13, is initiated accordingly.

Figure 4:
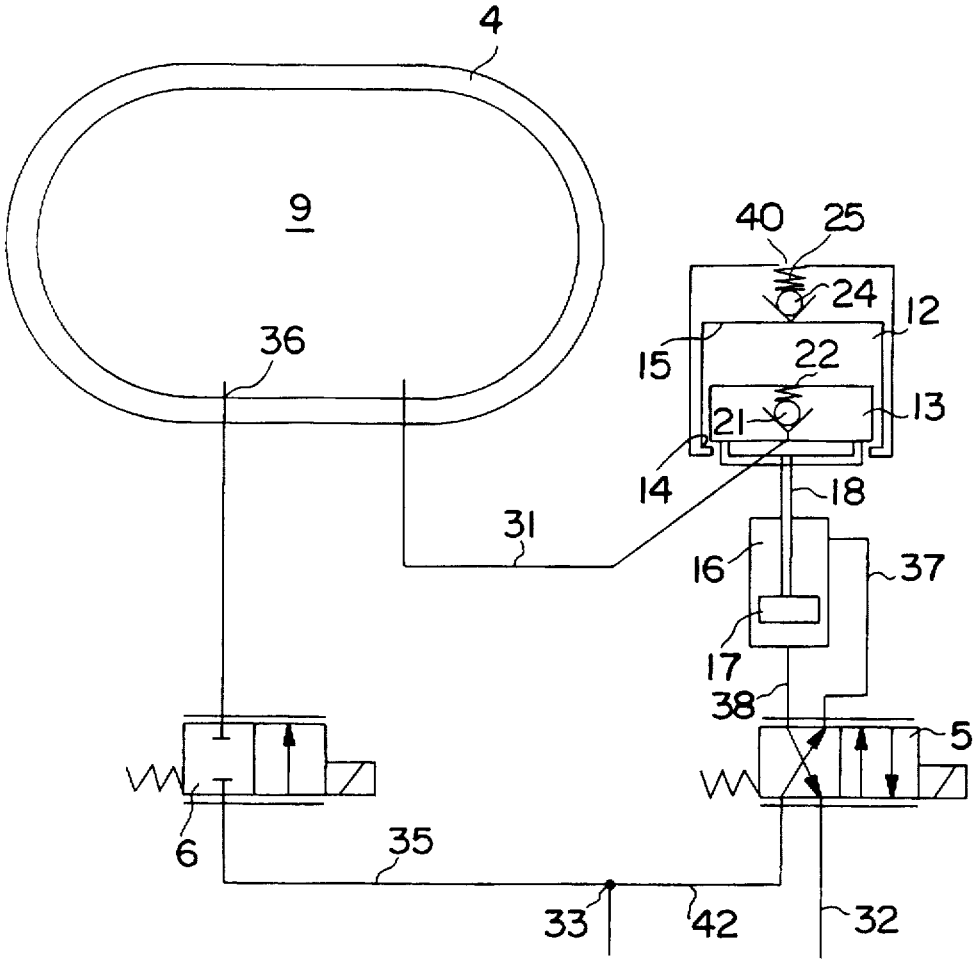
FIG. 4: is a connection diagram of a system incorporating the life jacket and the valve according to FIGS. 1 to 3, FIG. 5: is a view similar to FIG. 4 showing a connection diagram of an alternative system

FIG. 4 shows a schematic representation of the connection diagram of a system incorporating the life jacket and valve according to FIGS. 1 to 3. One can see, in FIG. 4, the life jacket 4 together with the interior 9 of the life jacket, the 2/2-way pilot-control inlet valve 6, which is a proportional directional valve, the 4/2-way pilot-control outlet valve 5, which is likewise a proportional directional valve, the pneumatic cylinder 16 together with the pilot-control piston 17, piston rod 18 and piston 13, the nonreturn valve 21 together with the associated spring 22, and the shut-off valve 24, likewise designed as a nonreturn valve, together with the associated spring 25. The pilot-control inlet valve 6 is acted upon via the inflator connection 33 and the pilot-control compressed-air feedline 35 and terminates in the region 36 of the interior 9 of the life jacket. By actuating the pilot-control inlet valve 6, compressed air is directed into the interior 9 of the life jacket, as a result of which the buoyancy of the diver (not shown here in any more detail) is increased. The pilot-control outlet 5 is acted upon via the line 42, compressed air being guided, via the lines 37 and 38, to the piston chamber and to the ring area of the pilot-control piston 17, respectively. Depending on the respective flow direction, the pilot-control piston 17, and the piston 13 connected thereto, is moved to and fro in an alternating manner, to be precise between the respective end positions 14 and 15. Depending on the intake, compression and displacement phase, which has already been outlined above, air is taken into the piston chamber 12 via the through-passage openings 31, represented here as a line, and is compressed here and discharged from said chamber to the surrounding medium via the through-openings 40.

Figure 5:
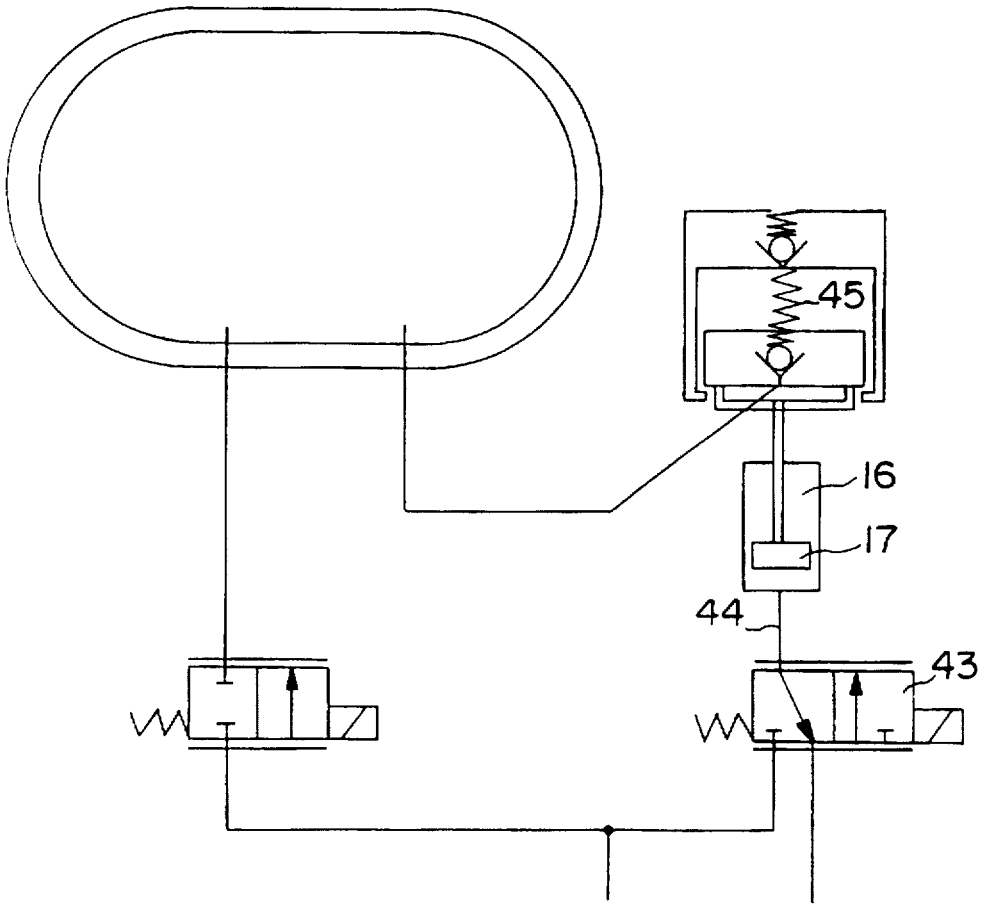

FIG. 5 shows an alternative connection diagram to FIG. 4. Instead of the 4/2-way valve according to FIG. 2, merely a 3/2-way valve 43 is provided in FIG. 5, which valve 43 acts on the head of the pilot-control piston 17 via a line 44. The pilot-control piston 17 is restored in this case by means of a correspondingly dimensioned restoring spring 45, as soon as the piston surface of the pneumatic cylinder 16 is depressurized to discharge. Otherwise, control takes place as for the 4/2-way valve according to FIG. 4.

Figure 6:
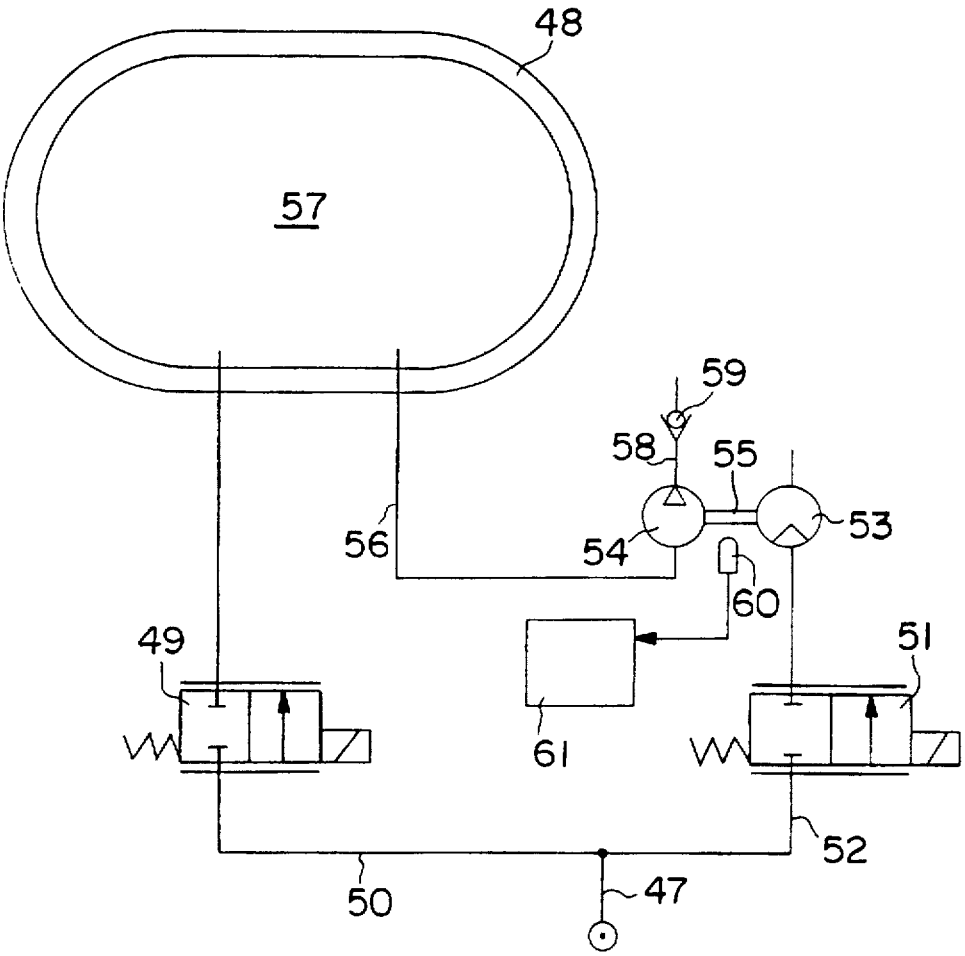
FIG. 6: is a view similar to FIG. 4 showing a connection diagram of yet another alternative system further incorporating a motor unit and a rotator unit.

FIG. 6 shows an alternative connection diagram to FIG. 5, the air intake, compression and displacement operation taking place differently from that in FIGS. 1 to 4. The components represented in this figure may be provided in the housing 2 (not shown here) analogously to the components according to FIGS. 1 to 4. The same applies for the feed of compressed air from the region of the inflator hose 47, which is shown schematically here. Furthermore, the following components are represented schematically: the life jacket 48; the air-inlet valve 49, which is connected to the inflator hose 47 via the line 50 (pilot-control compressed-air feedline); the pilot-control outlet valve 51, which is designed as a proportional 2/2-way valve and is likewise connected to the inflator hose 47 via a line 52; a unit 53 which acts as a motor; a pump 54 which acts as a rotator, is connected to the motor 53 via a shaft 55 and is in operative flow connection, via a further line 56, with the interior 57 of the life jacket. In the case of this alternative solution, the pneumatic unit 53, which acts as a motor, is acted upon by compressed air via the proportional 2/2-way valve 51 and is thus made to rotate. The rotational movement of the motor unit 53 is then utilized in order to drive the rotator pneumatic unit 54, which acts as a pump, mechanically via the shaft 55, as a result of which the unit 54 takes in air, via the line 56, from the interior 57 of the life jacket and displaces said air into the surrounding medium via the line 58, into which a nonreturn valve 59 is introduced. In this arrangement, the nonreturn valve 59 prevents water from penetrating into the pump chamber and thus also into the interior 57 of the life jacket 48. The level of the volume flow Q ($m^3$/min) is determined by the rotational speed n (rev/min) of the unit 54 and/or 53 being measured via a measuring device 60 and being multiplied by the delivery volume VG ($m^3$/rev) of the unit 54.

$$Q=VG\times n$$

In order to determine the air quantity V taken in from the interior 57 of the life jacket, either the air-volume flow can be integrated mathematically over time ($V=\int Q\,dt$) or the air quantity taken in at any one time can be determined by direct determination of the number of revolutions of the unit 54 by the measuring device 60 and by stepwise adding, within a computer unit 61, of the air quantity delivered per revolution, of the unit 54.

I claim:

1. A method of letting out gas from a life jacket for divers through a device adapted to be in gas flow communication with an interior of the life jacket, the method comprising the steps of:

drawing gas into the device from the interior of the life jacket;

compressing the gas in the device;

discharging the gas from the device to a medium surrounding the device;

performing the steps of drawing, compressing and discharging by:

utilizing an actuating element and a piston each being a part of the device, the actuating element being operatively connected to the piston; and actuating the actuating element between two end positions; and determining the end positions of the piston by utilizing a limit switch.

2. The method according to claim 1, further comprising the step of performing the steps of drawing, compressing and discharging cyclically and at a predetermined frequency.

3. The method according to claim 1, further comprising the step of initiating a changeover operation for reversing a direction of movement of the piston in a region of the respective end positions thereof.

4. The method according to claim 1, wherein the step of utilizing comprises the step of moving the piston between its end positions with an adjustable stroke.

5. The method according to claim 1, wherein the step of utilizing comprises the step of controlling a speed of the piston during its movement between its end positions according to a sine function.

6. The method according to claim 1, further comprising the step of controlling a speed of the piston at at least one of its end positions to be zero over a predetermined time periods.

7. The method according to claim 1, wherein the step of utilizing comprises the step of utilizing a piston chamber of the device which houses the piston therein, the piston chamber defining a first chamber portion adjacent a first end surface of the piston and a second chamber portion adjacent a second end surface of the piston, the device further including a nonreturn valve for closing and opening a first opening defined by the housing for establishing gas flow communication between the first chamber portion and the second chamber portion, and a shut-off valve for closing and opening a second opening defined by the housing for establishing gas flow communication between the second chamber portion and the medium surrounding the device, the method further comprising the steps of:

measuring an opening stroke of the nonreturn valve and of the shut-off valve for obtaining opening stroke measurements therefor; and controlling changeover operations of the piston as a function of the opening stroke measurements.

8. The method according to claim 1, further comprising the steps of:

moving the piston between its two end positions cyclically at a predetermined frequency; and controlling the frequency of the piston by utilizing a proportional directional valve of the device.

9. The method according to claim 8, further comprising the step of driving the actuating element by actuating the proportional directional valve.

10. The method according to claim 1, further comprising the steps of:

measuring a stroke of the piston; and comparing the stroke of the piston with a predetermined desired stroke.

11. A method of letting out gas from a life jacket for divers through a device adapted to be in gas flow communication with an interior of the life jacket, the method comprising the steps of:

drawing gas into the device from the interior of the life jacket;

compressing the gas in the device;

discharging the gas from the device to a medium surrounding the device; and performing the steps of drawing, compressing and discharging by utilizing a rotator unit and a motor unit each being a part of the device and being operatively connected to one another, the rotator unit being driven by the motor unit for pumping gas from the interior of the life jacket.

12. The method according to claim 11, further comprising the step of supplying the motor unit with compressed gas from a compressed gas source in gas flow communication with the motor unit.

13. The method according to claim 12, wherein the step of supplying comprises the step of adjusting a volume flow of the compressed gas to the motor unit as a function of a desired volume flow of the gas to be let out from the life jacket.

14. The method according to claim 13, wherein the step of adjusting comprises the step of adjusting the volume flow of the compressed gas to the motor unit in a continuous manner utilizing a proportional directional valve.

15. The method according to claim 11, further comprising the step of calculating a volume flow of gas being let out from the life jacket including the steps of:

measuring a rotational speed of one of the rotator unit and the motor unit for obtaining a measured rotational speed; and multiplying the measured rotational speed by a delivery volume thereof.

16. The method according to claim 15, further comprising the step of determining a volume of gas drawn into the device from the life jacket by integrating over time the volume flow of gas being let out from the life jacket.

17. The method according to claim 15, further comprising the step of determining a volume of gas drawn into the device from the life jacket during a given time period including the steps of:

measuring a number of revolutions of the rotator unit in the given time period; and adding, in steps, volumes of gas delivered by the rotator unit per revolution for the given time period.

18. A device for letting out gas from a life jacket for divers comprising:

a housing adapted to be in gas flow communication with an interior of the life jacket;

a piston chamber disposed in the housing;

a piston disposed in the piston chamber and reciprocatingly movable between two end positions for drawing gas into the device from the interior of the life jacket, compressing the gas in the device and discharging the gas from the device to a medium surrounding the device, the piston chamber further defining a first chamber portion adjacent a first end surface of the piston and a second chamber portion adjacent a second end surface of the piston, the housing defining a first opening therein for establishing gas flow communication between the first chamber portion and the second chamber portion and a second opening therein for establishing gas flow communication between the second chamber portion and the medium surrounding the device;

a nonreturn valve disposed in the housing for closing and opening the first opening;

a shut-off valve disposed in the housing for closing and opening the second opening;

an actuating element operatively connected to the piston and adapted to actuate the piston between its two end positions; and a drive valve disposed in the housing and operatively connected to the actuating element for driving the same to actuate the piston, the piston further being configured such that an actuation thereof actuates at least one of the nonreturn valve and the shut-off valve to open and close respective ones of the first opening and the second opening.

19. The device according to claim 18, wherein the housing is adapted to be disposed outside of the interior of the life jacket and to be releasably connected to the life jacket, the housing further defining an inlet region for establishing gas flow communication between the interior of the life jacket and the piston chamber.

20. The device according to claim 18, wherein the housing is adapted to be disposed in the interior of the life jacket.

21. The device according to claim 18, wherein the housing further includes a connection adapted to be connected to an inflator hose for supplying compressed gas to the device.

22. The device according to claim 21, wherein the drive valve comprises a pilot-control outlet valve for driving the actuating element by supplying compressed gas thereto, the device further comprising:

a pilot control inlet valve disposed in the housing and adapted to be placed in gas flow communication with the interior of the life jacket for supplying compressed gas thereto; and a pilot control compressed gas feedline connected to the connection at one end thereof and to at least one of the pilot control outlet valve and the pilot control inlet valve at another end thereof for supplying compressed gas to respective ones of the outlet valve and the inlet valve.

23. The device according to claim 22, wherein, the pilot control outlet valve is a 3/2 way valve.

24. The device according to claim 22, wherein the pilot control outlet valve is a 4/2 way valve.

25. The device according to claim 22, wherein the pilot control outlet valve is a proportional directional valve.

26. The device according to claim 22, wherein the actuating element comprises:

a pneumatic cylinder; and a pilot control piston having a piston head and a piston ring and reciprocatingly movable within the cylinder;

the device further comprising:

a first feedline connecting the pilot control outlet valve to the pneumatic cylinder at a region above the piston head; and a second feedline connecting the pilot control outlet valve to the pneumatic cylinder at a region below the piston ring.

27. The device according to claim 26, wherein the pilot control piston is coaxial with and operatively connected to the piston.

28. The device according to claim 26, wherein the housing comprises:

a rear wall defining one of the end positions of the piston;

a stationary valve seat defining another one of the end positions of the piston; and the pilot control piston is disposed in a region adjacent the rear wall.

29. The device according to claim 28, wherein:

the rear wall defines a third opening therein for establishing gas flow communication between the interior of the life jacket and the piston chamber; and the first opening is an opening defined in the piston.

30. The device according to claim 28, wherein the nonreturn valve is coaxial with the piston and rests sealingly against the second end surface of the piston for closing the first opening.

31. The device according to claim 30, further comprising a compression spring extending between the nonreturn valve and the stationary valve seat.

32. The device according to claim 28, wherein the second opening is a through-bore defined in the stationary valve seat.

33. The device according to claim 28, wherein:

the nonreturn valve is a first nonreturn valve;

the stationary valve seat defines a first side facing the nonreturn valve and a second side facing away from the nonreturn valve; and the shut-off valve comprises a second nonreturn valve disposed on the second side of the stationary valve seat.

34. The device according to claim 33, wherein the shut-off valve is coaxial with the piston and with the first nonreturn valve and rests sealingly against the second side of the stationary valve seat.

35. The device according to claim 34, wherein the housing comprises a wall section at an end region thereof, the device further comprising a compression spring extending between the shut-off valve and the wall section of the housing.

36. The device according to claim 35, wherein the wall section defines at least one opening therein to the medium surrounding the device.

37. The device according to claim 35, wherein the wall section comprises a termination cap releasably connected to the piston chamber.

38. The device according to claim 34, wherein the second opening is a through-bore defined in the stationary valve seat, the device further comprising a coaxial extension extending in an axial direction of the piston in a region of the nonreturn valve and being configured such that, in an end position of the piston adjacent the stationary valve seat, the coaxial extension coaxially passes through the through-bore and retains the shut-off valve in a raised position with respect to the second side of the stationary valve seat for opening the shut-off valve for discharging the gas from the device to the medium surrounding the device.

39. The device according to claim 22, wherein the pilot control outlet valve includes an outlet in gas flow communication with the medium surrounding the device.

40. The device according to claim 22, further comprising an electronic control unit for actuating at least one of the pilot control inlet valve and the pilot control outlet valve.

41. The device according to claim 21, further comprising:

a pilot control inlet valve comprising a 2/2 way valve disposed in the housing and adapted to be placed in gas flow communication with the interior of the life jacket for supplying compressed gas thereto;

a pilot control compressed gas feedline connected to the connection at one end thereof and to the pilot control inlet valve at another end thereof for supplying compressed gas to the inlet valve.

42. The device according to claim 18, wherein the piston is configured such that an actuation thereof to its end positions mechanically actuates at least one of the nonreturn valve and the shut-off valve to open respective ones of the first opening and the second opening.

43. A device for letting out gas from a life jacket for divers comprising:

a housing;

a rotator unit disposed in the housing;

a motor unit disposed in the housing and operatively connected to the rotator unit, the rotator unit being driven by the motor unit for pumping gas from the interior of the life jacket to a medium surrounding the device;

a valve system disposed in the housing for supplying compressed gas to at least one of an interior of the life jacket and the motor unit for driving the motor unit to in turn drive the rotator unit.

44. The device according to claim 43, wherein:

the housing includes a connection adapted to be connected to an inflator hose for supplying compressed gas to the device; and the valve system comprises a proportional 2/2 way valve for supplying compressed gas from the connection to the motor unit.

45. The device according to claim 43, further comprising a nonreturn valve in gas flow communication with an outlet of the rotator unit.

46. The device according to claim 43, further comprising a measuring device operatively connected to at least one of the rotator unit and the motor unit for determining a rotational speed thereof.

47. The device according to claim 46, further comprising a computer unit operatively connected to the measuring device.

* * * * *